US007059360B1

(12) United States Patent
Majaury et al.

(10) Patent No.: US 7,059,360 B1
(45) Date of Patent: Jun. 13, 2006

(54) DOUBLE LAYER FORMING FABRIC WITH PAIRED WARP BINDER YARNS

(75) Inventors: Brian Majaury, Perth Ont (CA); Bill Martin, Smiths Falls (CA)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 11/071,662

(22) Filed: Mar. 3, 2005

(51) Int. Cl.
*D21F 3/00* (2006.01)

(52) U.S. Cl. ..... 139/383 A; 162/900

(58) Field of Classification Search ..... 139/383 A; 162/900, 902, 903; 442/203, 205
See application file for complete search history.

(56) References Cited

U.S. PATENT DOCUMENTS 4,501,303 A 2/1985 Osterberg
4,564,051 A * 1/1986 Odenthal ..... 139/425 A
4,605,585 A 8/1986 Johansson
5,152,326 A 10/1992 Vohringer
5,429,686 A * 7/1995 Chiu et al. ..... 139/383 A
5,826,627 A * 10/1998 Seabrook et al. ..... 139/383 A
5,865,219 A 2/1999 Lee et al.
6,834,684 B1 12/2004 Martin et al.
6,883,556 B1 * 4/2005 Fahrer et al. ..... 139/383 A
6,905,574 B1 * 6/2005 Festor ..... 162/348
6,920,902 B1 * 7/2005 Majaury et al. ..... 139/383 A
6,953,065 B1 * 10/2005 Martin et al. ..... 139/383 A
6,989,079 B1 * 1/2006 Johnson et al. ..... 162/348

FOREIGN PATENT DOCUMENTS

EP 0 889 160 B 1/1999

* cited by examiner

*Primary Examiner*—Danny Worrell
*Assistant Examiner*—Robert H Muromoto
(74) *Attorney, Agent, or Firm*—Frommer Lawrence & Haug LLP; Ronald R. Santucci

(57) ABSTRACT

A papermaker's fabric, usable in the forming section of a paper machine, has first and second layers of cross-machine direction (CD) yarns interwoven with sets of machine-direction (MD) yarns. Each set has four pairs of MD yarns with each pair comprising a first MD yarn and a second MD yarn. The first and second MD yarns each cross between and weave with both the first and second layers of CD yarns. In the MD, each pair effectively produces a four-shed contour in the first layer and a two-shed contour in the second layer. Each pair is shifted in the CD, such that 4 pairs of MD yarns combine to effectively produce a four-shed contour in the CD in the first layer.

10 Claims, 4 Drawing Sheets

PRIOR ART

DOUBLE LAYER FORMING FABRIC WITH PAIRED WARP BINDER YARNS

BACKGROUND OF THE INVENTION

1. Field of the Invention

The present invention relates to the papermaking arts. More specifically, the present invention relates to forming fabrics for the forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

Those skilled in the art will appreciate that fabrics are created by weaving, and have a weave pattern which repeats in both the warp or machine direction (MD) and the weft or cross-machine direction (CD). Woven fabrics take many different forms. For example, they may be woven endless, or flat woven and subsequently rendered into endless form with a seam. It will also be appreciated that the resulting fabric must be uniform in appearance; that is there are no abrupt changes in the weave pattern to result in undesirable characteristics in the formed paper sheet. Due to the repeating nature of the weave patterns, a common fabric deficiency is a characteristic diagonal pattern in the fabric. In addition, any pattern marking imparted to the formed tissue will impact the characteristics of the paper.

The present invention may relate specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The properties of absorbency, strength, softness, and aesthetic appearance are important for many products when used for their intended purpose, particularly when the fibrous cellulosic products are facial or toilet tissue, paper towels, sanitary napkins or diapers.

To generate bulk, cross directional tensile, absorbency, and softness in a sheet of paper, a fabric will often be constructed so that the top surface exhibits topographical variations. These topographical variations are often measured as plane differences between strands. For example, a plane difference is typically measured as the difference in height between two adjacent weft (cross direction) strands in the plane of the wear side surface or as the difference in height between MD knuckles and CD knuckles in the forming surface. Bulk, cross directional tensile, absorbency, and softness are particularly important characteristics when producing sheets of tissue, napkin, and towel paper. Hence, tissue forming fabrics preferably exhibit plane differences in the forming side.

The design of forming fabrics additionally involves a compromise between the desired fiber support and fabric stability. A fine mesh fabric may provide the desired paper surface and fiber support properties, but such design may lack the desired stability resulting in a short fabric life. By contrast, coarse mesh fabrics provide stability and long life at the expense of fiber support and the potential for marking. To minimize the design tradeoff and optimize both support and stability, multi-layer fabrics were developed. For example, in double and triple layer fabrics, the forming side is designed for sheet and fiber support while the wear side is designed for stability, void volume, and wear resistance.

Double layer fabrics are commonly used within the paper industry. A typical double layer fabric comprises a set of forming weft yarns (shutes) and a set of wear weft yarns interwoven by a set of warp yarns. Most often, each of the warp yarns weaves the same contour pattern, only shifted by n shutes (weft yarns) from its neighboring warp yarn. After a number of such shifted warp yarns, the contour pattern has shifted a complete cycle and repeats the pattern (i.e. a complete pattern repeat). Typically, double layer fabrics are composed of 7, 8, 14, or 16 warp yarns. FIG. 1 is a schematic forming side view illustrating the surface weave pattern for a conventional double layer fabric. The fabric shown in FIG. 1 repeats every 8 warp yarns. In other words, the contour pattern of warp 1 would repeat as the next warp (9 not shown) above warp number 8, and vice versa. This pattern continues repeating (in the CD) across the fabric.

Many double layers fabrics incorporate a "paired warp" concept in which two warps yarns act together (i.e. as a pair) to effectively weave one unbroken contour in the top surface of the fabric. References describing fabrics with paired MD yarns include U.S. Pat. No. 4,605,585 (the "Johansson" patent) directed to a double layer fabric wherein as one warp yarn dips to the wear side layer the other warp yarn in the pair takes its place in the forming layer, U.S. Pat. No. 4,501,303 (the "Österberg" patent) where the warp yarn pairs are an integral part of the top layer but act as binding yarns on the bottom layer, U.S. Pat. No. 5,152,326 (the "Vöhringer" patent) where the paired warp yarns are vertically-stacked and integral to both the top and bottom layers, and U.S. Pat. No. 5,865,219 (the "Lee" patent) in which the warp yarn pairs produce a plain weave pattern in both the top and bottom layers.

Multi-layer fabrics, such as double or triple layer fabrics, may have unacceptable resistance to internal abrasion and/or the weave may loosen (i.e. the yarns may slide from their original positions within the pattern) during use. The present invention provides a fabric which overcomes such disadvantages.

SUMMARY OF THE INVENTION

Accordingly, the present invention is a forming fabric, although it may find application in the forming, pressing and drying sections of a paper machine.

The present invention is preferably a forming fabric having a double layer weave construction formed using sets of paired warp yarns. To address the tradeoff between desired fiber support and fabric stability, each warp yarn acts to bind the layers, thereby eliminating the need for additional binder yarns. Moreover, in the MD, each pair produces a four-shed pattern in the forming layer and a plain weave pattern in the wear layer. In the CD, the pairs combine to complete the four-shed pattern in the forming layer and form parallel contour patterns in the wear layer. This construction gives the double layer fabric characteristics of a triple layer fabric.

In a preferred embodiment, the fabric has first and second layers of CD yarns interwoven with sets of MD yarns. Each set has four pairs of MD yarns with each pair comprising a first MD yarn and a second MD yarn. The first and second MD yarns each cross between and weave with both the first and second layers of CD yarns. The first MD yarn binds a single CD yarn in the second layer. In the MD, each pair effectively produces a four-shed contour in the first layer and a two-shed contour in the second layer. Each pair is shifted in the CD, such that 4 pairs of MD yarns combine to effectively produce a four-shed contour in the CD in the first layer. In the second layer, two pairs of MD yarns combine to effectively produce parallel two-shed contours in the MD in the second layer.

The fabric is preferably a double layer forming fabric wherein the first layer is a forming side of the fabric and the second layer is a wear side of the fabric with the first and second layers being bound together by the sets of MD yarns. Each pair is preferably shifted from the next pair by 9 CD yarns in the first layer. The fabric may be suitable for producing tissue, napkin, and towel paper.

Other aspects of the present invention include that the CD yarns in the second layer may be a different diameter than in the first layer. At least some of the MD yarns and CD yarns may be monofilament yarns and may be one of polyamide yarns or polyester yarns. The fabric may be woven on a 16 harness loom. At least some of the MD yarns and CD yarns have one of a circular cross-sectional shape, a rectangular cross-sectional shape and a non-round cross-sectional shape.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The present invention is preferably a double layer forming fabric woven with first and second layers of cross-machine direction (CD) weft yarns interwoven with sets of paired machine-direction (MD) warp yarns. However, unlike prior art paired warp fabrics where each pair forms a complete pattern, the present invention combines plural pairs into a set to complete the forming and wear layer patterns. For example, the warp yarns of a single pair may combine to weave a four-shed pattern in the MD in the forming layer of a fabric. But, this pair by itself does not necessarily produce a four-shed pattern in the CD. In the present invention, four staggered pairs of warp yarns could be viewed as a set to effectively produce the four-shed pattern in the CD. In this manner, a set of paired warp yarns can be used to form a complete four-shed pattern in both the MD and CD.

Advantages of the present invention include a double layer constructed fabric which has the appearance and characteristics similar to a triple layer fabric. The present invention eliminates the need for smaller diameter binder yarns in either the MD or CD which can prematurely wear out and allow separation of the fabric layers. In addition, CD binder shutes do not need to be inserted into the fabric, thereby eliminating 20–25% of the total picks required. Since all of the warp yarns also act as binder yarns, a third warp beam for MD binder yarns is not needed. The present fabrics can be woven on any double beam loom capable of running standard double layer, eight or sixteen shed designs, equipped with sixteen harness frames properly threaded in and reeded either two or four ends per dent. The present fabric's double layer construction also exhibits improved seam strength over present triple-layer designs.

Figure 1:
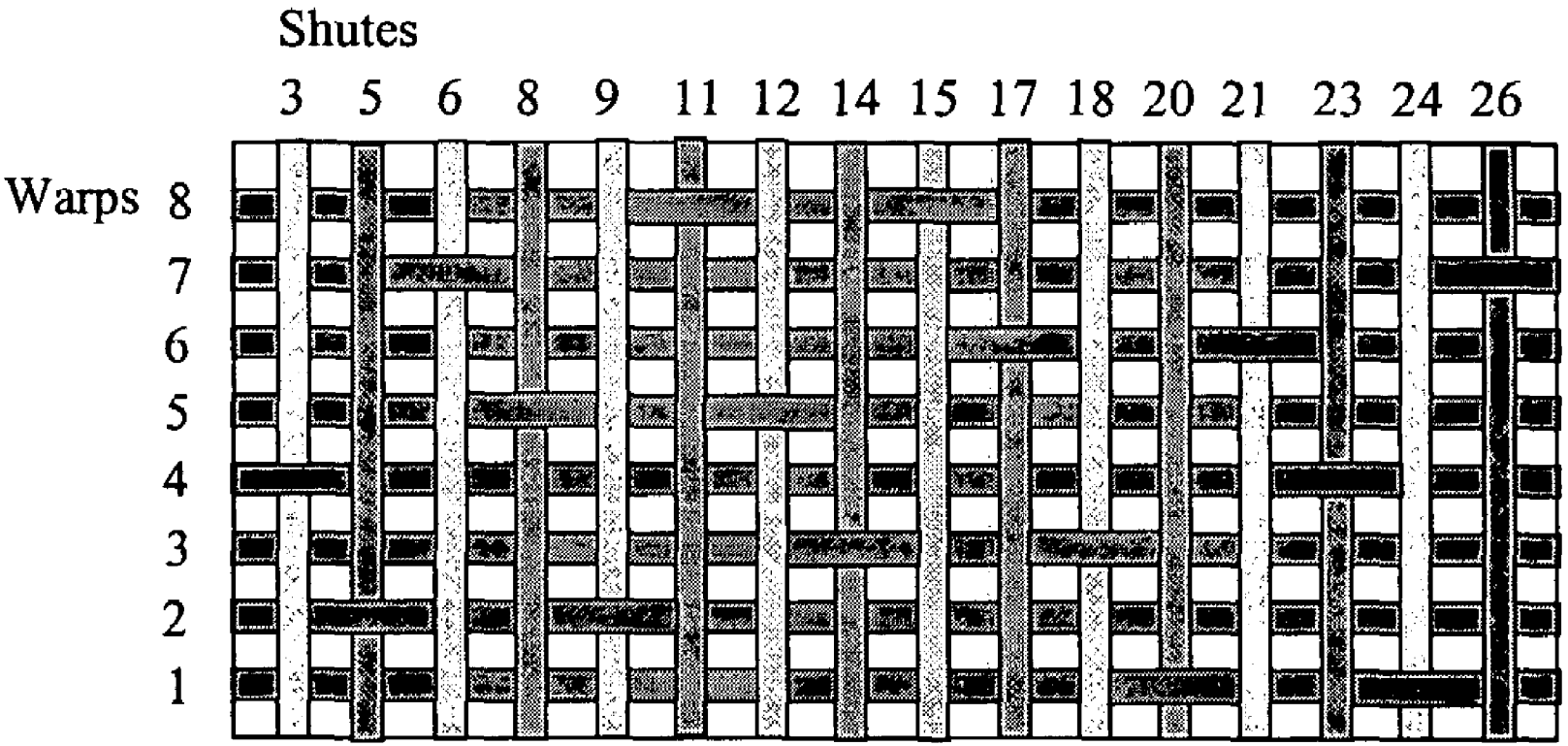
FIG. 1 is a schematic forming side view illustrating the surface weave pattern for a conventional double layer fabric.
Figure 2:
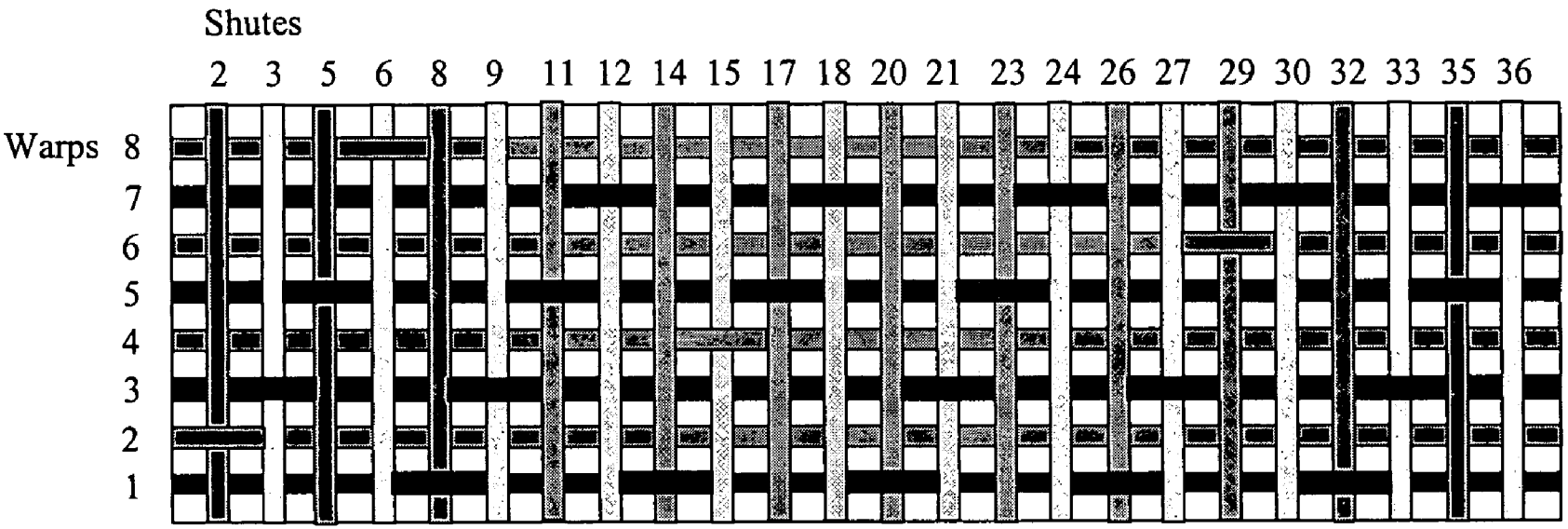
FIG. 2 is a schematic forming side view illustrating the surface weave pattern for a fabric woven in accordance with the teachings of the present invention.
Figure 3:
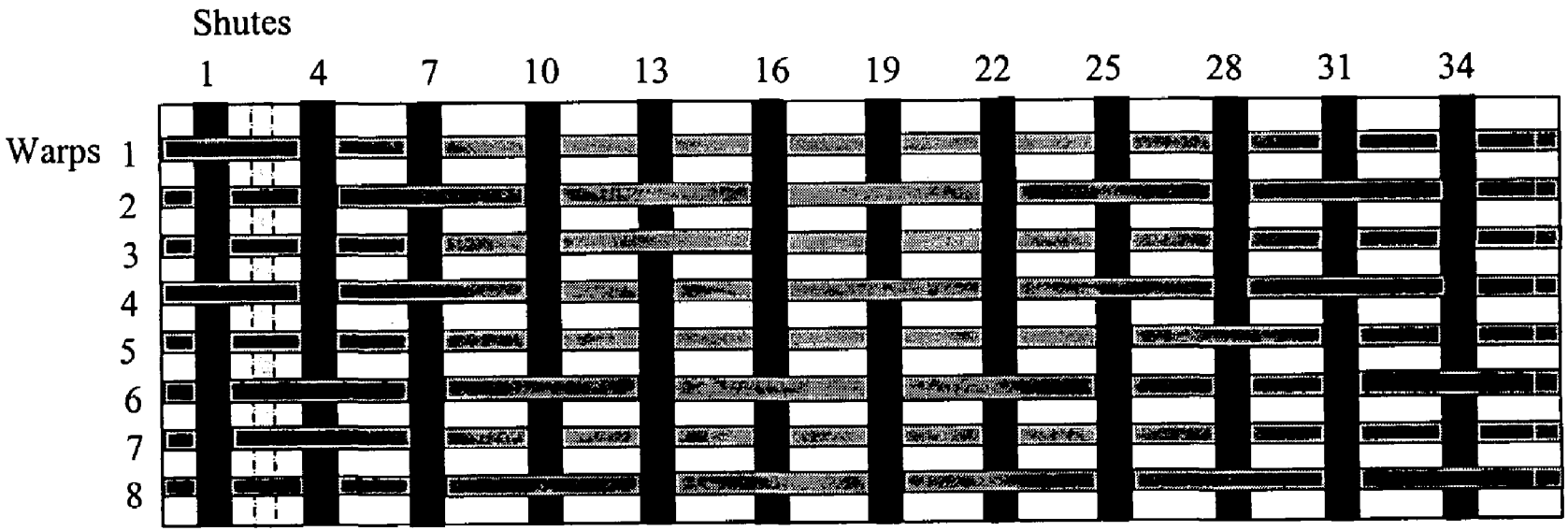
FIG. 3 is a schematic wear side view illustrating the surface weave pattern for a fabric woven in accordance with the teachings of the present invention.
Figure 4:
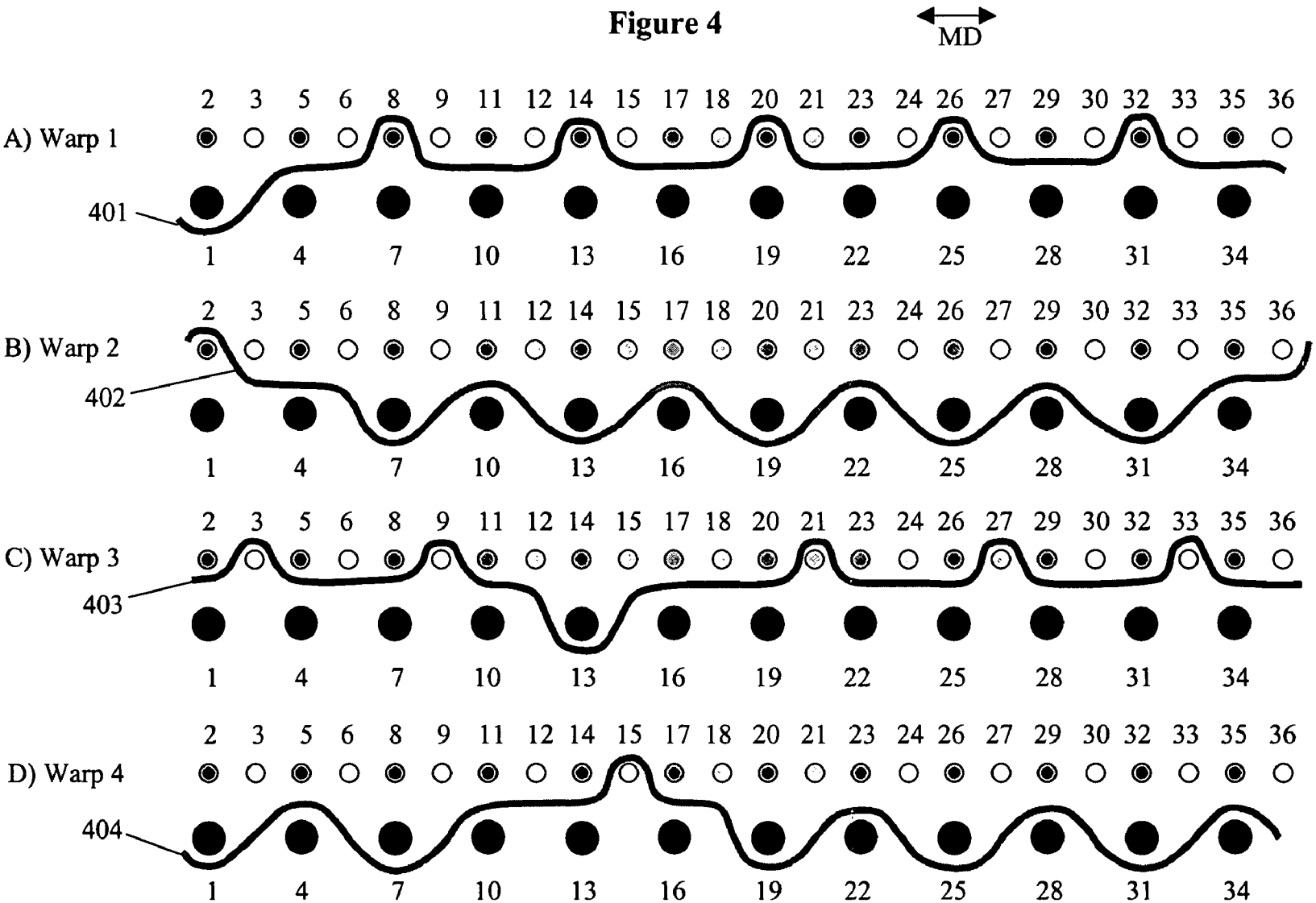
FIG. 4 is a set of 4 schematic cross-sectional views in the cross-machine direction (CD) showing exemplary warps contour patterns for the fabric shown in FIGS. 2 and 3.

A preferred embodiment of the invention in which the fabric produces a four-shed pattern in the forming layer and a plain weave pattern in the wear layer is shown in FIGS. 2–4.

FIG. 2 is a schematic forming side view illustrating the surface weave pattern for a preferred embodiment of the invention. In FIG. 2, the warp yarns 1–8 weave in the MD, horizontally across the figure. The forming layer CD yarns (i.e. shutes or wefts) run vertically in the figure. The warp yarns can be viewed in pairs (1–2, 3–4, 5–6, 7–8), with each pair effectively forming a four-shed pattern in the MD. For example, warp yarn 1 weaves over shute yarns 8, 14, 20, 26, and 32 while paired warp yarn 2 weaves over shute yarn 2. Together, warp yarn 1 and warp yarn 2 weave over every fourth shute. When the pair is viewed as a single unit, it produces a four-shed warp contour pattern. Each pair of warp yarns is shifted (staggered) from the next pair by 9 forming layer CD yarns. In the CD, four pairs (warp yarns 1–8) work together to produce a four-shed weft contour pattern. This weft contour is commonly referred to as a 3+1 pattern, meaning a forming weft yarn passes over three warp yarns before passing under one warp yarn. More specifically, warp yarns 1–2, 3–4, 5–6, and 7–8 form pairs that combine to effectively produce a single "unbroken" contour pattern. For example, although shute 8 passes under warp yarn 1 and over warp yarns 2–8, since the warps are paired this is equivalent to passing under 1 pair and over 3 pairs to form a four-shed pattern in the CD. In this manner, four such pairs are required to complete the four-shed pattern in both the MD and CD. The fabric pattern repeats after 8 warps.

FIG. 3 is a schematic wear side view illustrating the surface weave pattern for the fabric shown in FIG. 2. Warp yarns 1–8 are the same in each figure but are shown in reversed order as a result of viewing the other side of the fabric. The wear layer CD yarns 1, 4, 7, . . . have a larger diameter and are vertically stacked with forming layer CD yarns 2, 5, 8, . . . Forming layer CD yarns 3, 6, 9, . . . are spaced between the wear layer CD yarns (as indicated by the dashed line yarn between shutes 1 and 4), but for clarity are not shown. Paired warp yarns 1 and 2 combine to form a two-shed (plain weave) pattern with the wear side shute yarns. Specifically, warp yarn 1 only passes over shute yarn 1; whereas warp yarn 2 passes over shute yarns 7, 13, 19, 25, and 31. In this manner, warp yarns 1 and 2 effectively combine to produce a two-shed (i.e. plain weave) warp contour pattern. Warp yarns 3 and 4 work together in the same manner; i.e. together they pass over shute yarns 1, 7, 13, 19, 25, and 31. These two pairs (four total warp yarns) provide the effect of forming two unbroken, parallel contours. Warp yarn pairs 5–6 and 7–8 are shifted by one weft; i.e. they pass under shute yarns 1, 7, 13, 19, 25, and 31 and over shute yarn 4, 10, 16, 22, 28, and 34.

FIG. 4 is a set of 4 schematic cross-sectional views in the cross-machine direction (CD) showing exemplary warps contour patterns for warp yarns 1–4 of the fabric shown in FIGS. 2 and 3. For example, warp yarn 1 (401) binds with CD yarn 1 in the wear layer before traversing to the forming layer and weaving over CD yarns 8, 14, 20, 26, and 32 (every fourth CD yarn). Warp yarn 1 is paired with warp yarn 2 (402) which binds with CD yarn 2 in the forming layer before traversing to the wear layer and weaving with every other CD yarn. As shown, warp yarns 1 and 2 combine to weave every fourth CD yarn in the forming layer (i.e. a four-shed pattern) and every second CD yarn in the wear layer (i.e. a two-shed or plain weave pattern). Warp yarns 3 (403) and 4 (404) combine to produce similar patterns, but have been shifted to the right by 9 forming layer CD yarns. Note that only one warp yarn in each pair is integral to the wear layer. The other warp yarn in each pair weaves predominantly in the forming layer and simply binds with one shute yarn in the wear layer.

The fabric according to the present invention preferably comprises only monofilament yarns, preferably of polyester, nylon, polyamide, or other polymers. Any combination of polymers for any of the yarns can be used as identified by one of ordinary skill in the art. The CD and MD yarns may have a circular cross-sectional shape with one or more different diameters. For example, the forming layer weft yarns may be a different diameter than the wear layer weft yarns. Typical forming layer weft yarn diameters are between 0.11 and 0.15 mm with wear layer weft yarn diameters between 0.17 and 0.30 mm. Warp yarn diameters typically range between 0.10 and 0.15 mm. However, any combination of diameters can used and these exemplary diameters should not be construed as limiting the invention in any way. Further, in addition to a circular cross-sectional shape, one or more of the yarns may have other cross-sectional shapes such as a rectangular cross-sectional shape or a non-round cross-sectional shape.

Modifications to the above would be obvious to those of ordinary skill in the art, but would not bring the invention so modified beyond the scope of the present invention. The claims to follow should be construed to cover such situations.

What is claimed is:

1. A papermaker's fabric comprising:

a first layer and a second layer of cross-machine direction (CD) yarns;

sets of machine-direction (MD) yarns, wherein each set has four pairs of MD yarns with each pair comprising a first MD yarn and a second MD yarn;

wherein the first MD yarn and the second MD yarn each cross between and weave with both the first and second layers of CD yarns; the first MD yarn binding a single CD yarn in the second layer;

wherein in the MD, each pair effectively produces a four-shed contour in the first layer and a two-shed contour in the second layer;

wherein each pair is shifted in the CD, such that 4 pairs of MD yarns combine to effectively produce a four-shed contour in the CD in the first layer;

wherein 2 pairs of MD yarns combine to effectively produce parallel two-shed contours in the MD in the second layer.

2. The papennaker's fabric according to claim 1, wherein the first layer is a forming side of the fabric and the second layer is a wear side of the fabric.

3. The papermaker's fabric according to claim 1, wherein each pair is shifted from the next pair by 9 CD yarns in the first layer.

4. The papermaker's fabric according to claim 1, wherein the CD yarns in the second layer are a different diameter than in the first layer.

5. The papermaker's fabric according to claim 1, wherein at least some of the MD yarns and CD yarns are monofilament yarns.

6. The fabric according to claim 1, wherein at least some of the MD yarns and CD yarns are one of polyamide yarns or polyester yarns.

7. The papermaker's fabric according to claim 1, wherein the fabric is woven on a 16 harness loom.

8. The papermaker's fabric according to claim 1, wherein the fabric is a double layer fabric.

9. The fabric according to claim 1, wherein at least some of the MD yarns and CD yarns have one of a circular cross-sectional shape, a rectangular cross-sectional shape and a non-round cross-sectional shape.

10. The fabric according to claim 1, wherein the fabric is a forming fabric for producing tissue, napkin, and towel paper.

* * * * *